United States Patent [19]

Kich et al.

[11] Patent Number: 4,780,694

[45] Date of Patent: Oct. 25, 1988

[54] DIRECTIONAL FILTER SYSTEM

[75] Inventors: Rolf Kich, Redondo Beach; Paul J. Tatomir, Torrance; Martin B. Hammond, Glendora, all of Calif.

[73] Assignee: Hughes Aircraft Company, Los Angeles, Calif.

[21] Appl. No.: 124,328

[22] Filed: Nov. 23, 1987

[51] Int. Cl.[4] ..... H01P 1/207; H01P 1/208; H01P 1/209

[52] U.S. Cl. ..... 333/208; 333/137; 333/212; 333/248

[58] Field of Search ..... 333/208–212, 333/238, 239, 248, 109, 110, 113, 129, 132, 137, 1, 27, 21 R, 136

[56] References Cited

U.S. PATENT DOCUMENTS 3,074,033 1/1963 Smith ..... 333/110

3,234,555 2/1966 Petrilla et al. ..... 333/110

*Primary Examiner*—Marvin L. Nussbaum

*Attorney, Agent, or Firm*—S. M. Mitchell; M. J. Meltzer; A. W. Karambelas

[57] ABSTRACT

A filter system is composed of two identical filters coupled between an input waveguide and an output waveguide to provide a 4-port directional filter characteristic operable with quasi-elliptic linear modes of electromagnetic propagation within each of the filters. Each of the filters may be constructed of a plurality of cavities arranged serially, one behind the other, with one of the cavities in each of the filters being employed for coupling electromagnetic power between the two waveguides. The coupling is accomplished by use of a transverse slot and a longitudinal slot in each of the waveguides, the slots extending through sidewalls of the waveguides into walls of the cavity in each of the filters for symmetric and antisymmetric coupling, respectively, of longitudinal and transverse components of a transverse electric wave in each of the waveguides. A phase quadrature relationship between components of a magnetic field coupled from the input waveguide is retained by the filters and, upon radiation via the slots into the output waveguide, results in the generation of an output wave in only one direction from the output waveguide, there being cancellation of a wave in the opposite direction from the output waveguide.

8 Claims, 3 Drawing Sheets

DIRECTIONAL FILTER SYSTEM

BACKGROUND OF THE INVENTION

This invention relates to directional filters having four ports and, more particularly, to a filter system employing a pair of filters connected in phase quadrature between two waveguides employing symmetric and antisymmetric radiators to develop directional characteristics using linear electromagnetic propagation modes within the pair of filters.

Filters are commonly employed in the processing of electromagnetic signals. For example, such signals may be obtained from an array of antenna elements positioned for receiving a microwave signal. A common construction of such filters employs a series of cavities constructed of a cylindrical wall closed off by end walls and having portions, with divider walls set within the cylindrical wall to define a series of cavities arranged, one behind the other. The walls are made of an electrically conducting material, typically a metal such as aluminum, brass or silver plated steel. The divider walls have apertures for coupling electromagnetic power between adjacent cavities. The dimensions of the cavities and the configuration of the coupling apertures, or irises, are selected to provide for a desired bandpass characteristic to signals propagating through the filter.

A situation of particular interest involves the filtering of several signals simultaneously to provide a set of filtered signals, this being followed by a combination of the filtered signals to provide a sum of the filtered signals. Such combination has been accomplished by the use of a waveguide manifold having several ports which connect with output ports of respective ones of the filters. In order to operate the manifold with the set of filters, it is important to ensure that signals outputted by individual ones of the filters do not interfere with the operation of other ones of the filters resulting in signal distortion. Therefore, the various filters must be electrically isolated from each other to insure proper combination of the filtered signals at the manifold.

One form of isolation which has been employed involves the use of four-port filters having a directional characteristic in the sense that a signal applied to one of two input ports exits from only one designated output port of a pair of output ports. With such an arrangement, the characteristics of the filter, which may be described mathematically by a scattering matrix, allow for the connection of several of the filters to one manifold without interference being introduced into the operation of one filter by the presence of another filter.

Heretofore, such a four-port directional filter has been built by use of circularly polarized filters in which the two components of right-hand and left-hand polarizations have allowed the implementation of a filter with the necessary scattering matrix to allow for a parallel combination of signals from several filters at a manifold. However, such circularly polarized filters have permitted design only in accordance with a Chebyshev characteristic (filter transfer function), but does not admit the well known design by quasi-elliptic linear mode transfer function.

Thus, a problem exists in that existing microwave filter structure which provide the desirable four-port directional characteristic are limited to circular polarization, with only a Chebyshev transfer function and do not admit implementation with filter structures operative with linear mode.

SUMMARY OF THE INVENTION

The foregoing problem is overcome and other advantages are provided by a directional filter system which, in accordance with the invention, comprises a pair of matched filters interconnected between two waveguides of rectangular cross section, which waveguides are operative in a transverse electric mode of propagation of electromagnetic waves. Each filter of the pair of matched filters, may be operated in a quasi-elliptic linear mode and is not limited to a specific transfer function, as well as in a mode of circular polarization. In the construction of the preferred embodiment of the invention, a quasi-elliptic linear mode in a canonical configuration is presumed. One of the two waveguides serves as an input waveguide, and the other of the two waveguides serves as an output waveguide of the filter assembly.

In accordance with a preferred embodiment of the invention, both of the waveguides are provided with coupling devices for coupling power from both a longitudinal component and a transverse component of the magnetic field of the transverse electric (TE) wave. Alternatively, if a transverse magnetic (TM) wave is employed in each of the waveguides, then the coupling devices are constructed for coupling power from the longitudinal component and the transverse component of the electric field of the TM wave. In the preferred embodiment of the invention, a TE wave is employed and, accordingly, the inventive concept will be explained in the ensuing description with respect to the TE wave, it being understood that the concept applies equally well to a TM wave.

The coupling devices at the input waveguide provide for a coupling of power from the transverse field component to a first filter of the pair of filters, and power from the longitudinal field component to a second filter of the two filters. In the preferred embodiment of the invention, each of the coupling devices is formed as a slot for coupling power from the components of the magnetic field, the transverse component being coupled by a slot disposed in a broad wall transverse to a longitudinal axis of the input waveguide, and the longitudinal component being coupled by a slot disposed in a narrow wall parallel to the longitudinal axis. The two filters abut the input waveguide, and the transverse slot continues through the broad wall of the input waveguide and into a sidewall of the first filter. The longitudinal slot continues through the narrow wall of the input waveguide and into an end wall of the second filter.

As is well known, the transverse slot in the broad wall radiates into the rectangular waveguide in an antisymmetric radiation pattern such that the electric fields traveling through the waveguide on either sides of the slot have the opposite sense. The longitudinal slot radiates symmetrically into the rectangular waveguide such that electric fields traveling through the waveguide on either sides of the slot have the same sense. The slots are centered on a common transverse plane in the input waveguide, and similarly with the output waveguide. With respect to the components of the magnetic field coupled by both of the slots, the transverse component of the magnetic field is 90 degrees out of phase with the longitudinal component of the magnetic field. Therefore, the coupling of electromagnetic power from the input waveguide into the two filters is accomplished in phase quadrature.

The two filters are coupled to the output waveguide by abutment of the two filters against the output waveguide, and by use of the same coupling devices, namely, a transverse slot in the broad wall and a longitudinal slot in the narrow wall of the output waveguide. The first filter which is coupled via the transverse slot to the input waveguide is coupled by a longitudinal slot to the output waveguide. The second filter which is coupled via a longitudinal slot to the input waveguide is coupled by a transverse slot to the output waveguide. In each waveguide, as noted above, the longitudinal slot is centered on a transverse plane of the transverse slot to insure the phase quadrature relationship. Alternatively if desired, the longitudinal slots can be advanced in position along the respective waveguides by a distance of an integral number of one-half guide wavelengths of the TE wave to allow for greater flexibility in positioning of the filters while retaining the phase quadrature relationship. The longitudinal slot may also be moved to the edge of the broadwall and still maintain phase quadrature. In this case both slots would couple in to the endwall of the resonator.

In view of the phase quadrature relationship, and in view of the coupling by both symmetric and antisymmetric coupling devices into the output waveguide, the contributions of electromagnetic waves excited in the output waveguide by the two filters result in the generation of an output wave in the output waveguide which propagates in only one direction in the output waveguide. By viewing both ends of the input waveguide as two input ports and both ends of the output waveguide as two output ports, there is provided a set of four ports to the filter system which responds to a wave inputted at one of the input ports by producing a reflected wave at the second of the input ports and an output wave at only one of the output ports, the second of the output ports providing no output wave because of cancellation between the symmetric and antisymmetric generation of waves within the output waveguide. The foregoing operation is reciprocal in the sense that a wave can be inputted at a port of the output waveguide to exit from one port of the input waveguide. This provides the requisite directional characteristic to a four-port filter assembly. A feature of the invention is the fact that, in the foregoing construction, there has been no restriction on the characteristics or configuration of the linear propagation modes within either of the two filters, the only restriction being that the two filters should function identically so as to preserve the phase quadrature relationship and spectra of the two components of the magnetic field of the input waveguide.

BRIEF DESCRIPTION OF THE DRAWING

The foregoing aspects and other features of the invention are explained in the following description, taken in connection with the accompanying drawing wherein.

DETAILED DESCRIPTION

Figure 1:
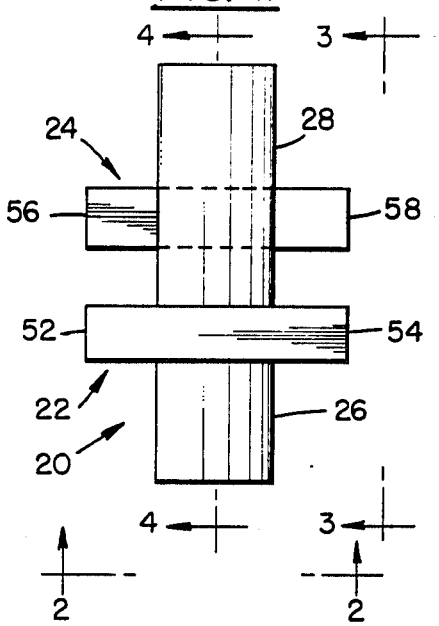
FIG. 1 is a plan view of an assembly incorporating a filter system in accordance with the invention.
Figure 3:
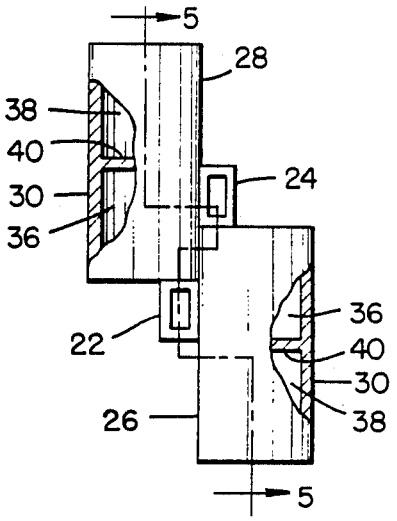
FIG. 3 is a side view of the assembly of the filter system as viewed along the line 3—3 in FIG. 1.
Figure 2:
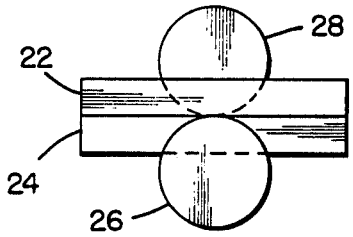
FIG. 2 is an end view of the assembly as viewed along the line 2—2 in FIG. 1.

With reference to FIGS. 1–6, there is shown a filter system 20 incorporating the invention. The system 20 is formed as an assembly of input and output waveguides 22 and 24 which are interconnected by two parallel signal paths provided by first and second filters 26 and 28. The theory of the invention is not restricted to any specific physical shape of filter; however, the two filters 26 and 28 should have identical characteristics particularly with respect to phase shift and signal group delay between input and output terminals of each of the filters 26 and 28.

By way of example in construction of the filters 26 and 28, each of the filters is constructed of a right cylindrical sidewall 30 closed off by a front end wall 32 and a back end wall 34 to form a set of resonators constructed as a set of serially arranged cavities. By way of example, two such cavities, namely, a front cavity 36 and a back cavity 38 are provided, the two cavities 36 and 38 being separated by a divider wall 40 disposed midway between the end walls 32 and 34 and supported by the sidewall 30. A coupling iris 42 formed, by way of example, as a crossed slot, is centered on the diver wall 40 in each of the filters 26 and 28. In the crossed slot configuration of each of the coupling irises 42, one slot is parallel to each of the waveguides 22 and 24, and the other slot is perpendicular to each of the waveguides 22 and 24. The filters 26 and 28, as well as the waveguides 22 and 24, are constructed of electrically conducting material, preferably a metal such as aluminum or brass.

Each of the waveguides 22 and 24 is constructed of four sidewalls, two of which are broadwalls 44 and 46 and two of which are narrow walls 48 and 50, the narrow walls 48 and 50 interconnecting the broadwalls 44 and 46 to form a rectangular cross section wherein the width of a broad wall is twice the width of a narrow wall. The sidewalls of the waveguide 22 are parallel to the sidewalls of the waveguide 24.

Figure 7:
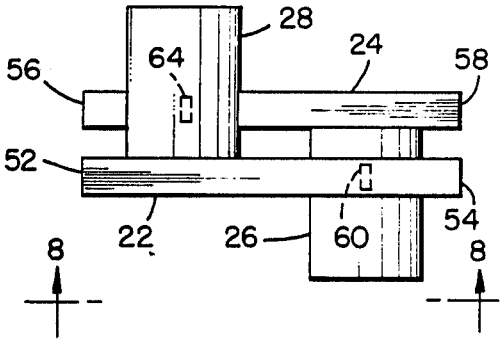
FIG. 7 is a plan view of an alternative embodiment of the assembly of FIG. 1 wherein two filters are displaced transversely from each other along a pair of waveguides.
Figure 8:
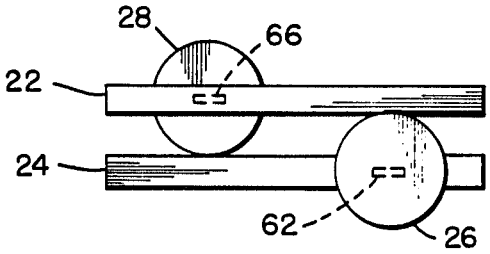
FIG. 8 is an end view of the alternative embodiment as viewed along the line 8—8 in FIG. 7.
Figure 5:
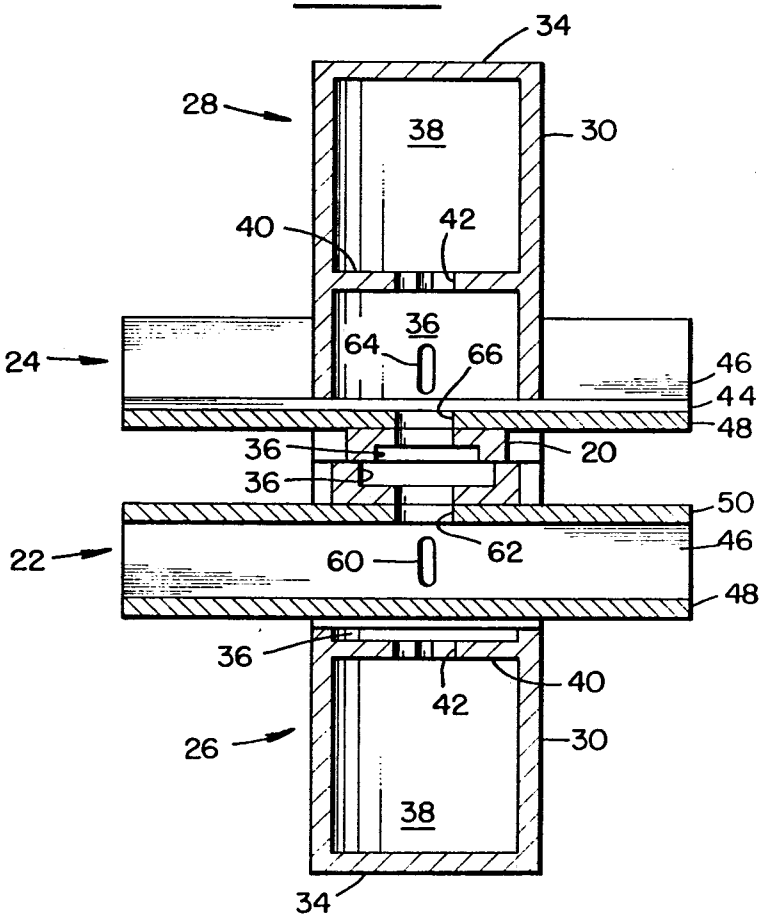
FIG. 5 is a sectional view of the assembly taken along a sinuous line 5—5 shown in FIG. 3.
Figure 4:
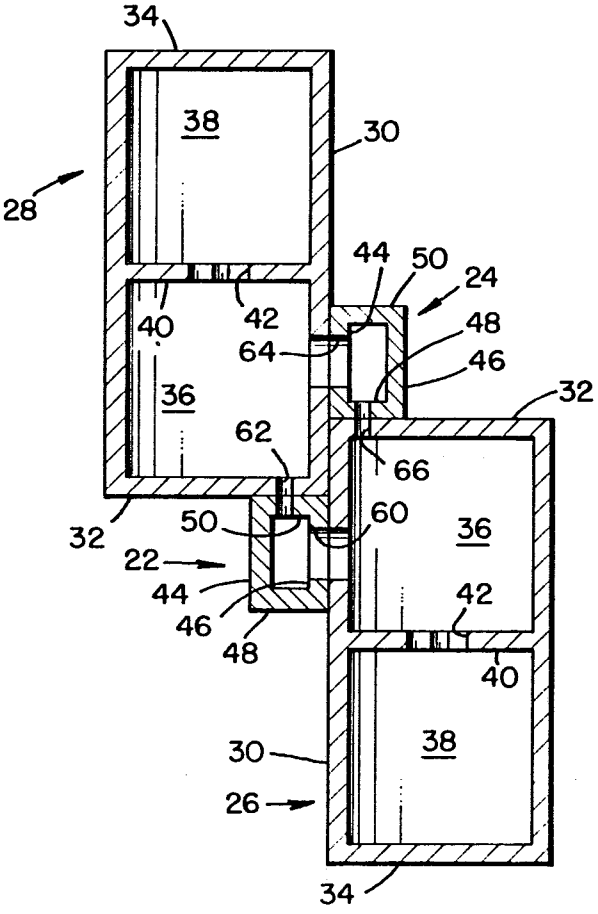
FIG. 4 is a sectional view of the assembly taken along the line 4—4 in FIG. 1.

With reference to FIGS. 1–8, the interconnection of the filters 26 and 28 to the waveguides 22 and 24 may be accomplished in a compact configuration wherein the front ends of the two waveguides overlap each other, as is shown in FIGS. 1–6, or in an alternative configuration wherein the filters 26 and 28 have been displaced parallel to each other in a spaced-apart configuration as shown in FIGS. 7 and 8.

In both of the foregoing embodiments, the input waveguide 22 has a pair of opposed open ends which serve as input ports 52 and 54 to the system 20. Similarly, the output waveguide 24 has a pair of opposed open ends which serve as output ports 56 and 58 to the system 20. In the preferred embodiment of the invention, each of the waveguides 22 and 24 supports a transverse electric (TE) wave in which a magnetic field of the wave has both a transverse component and a longitudinal component, the transverse and longitudinal components of the magnetic field being out of phase by 90 degrees.

In accordance with the invention, electromagnetic power from the TE wave is coupled separately from the transverse and longitudinal components of the magnetic field to respective ones of the cavities from the input waveguide 22. Similarly, power from the electromagnetic waves established within each of the filters 26 and 28 is separately coupled into the output waveguide 24 to establish therein transverse and longitudinal components of the magnetic field of the output TE wave.

In the preferred embodiment of the invention, the separate coupling of the transverse and longitudinal components of the magnetic field is accomplished by means of slots arranged transversely and longitudinally within individual ones of the sidewalls of the input waveguide 22 and the output waveguide 24. A total of four slots are employed, the slots being as follows.

In the input waveguide 22, a transverse slot 60 is disposed in the broad wall 46 and extends through the sidewall 30 to the first filter 26 for coupling electromagnetic power between the input waveguide 22 and the front cavity 36 of the first filter 26. In the input waveguide 22, a longitudinal slot 62 is disposed in the narrow wall 50 and extends through the front wall 32 of the second filter 28 for coupling electromagnetic power from the input waveguide 22 to the front cavity 36 of the second filter 28. In the output waveguide 24, a transverse slot 64 is located in the broad wall 44 and extends through the sidewall 30 of the second filter 28 for coupling electromagnetic power between the front cavity 36 of the second filter 28 and the output waveguide 24. In the output waveguide 24, a longitudinal slot 66 is disposed in a narrow wall 48 and extends through the front wall 32 of the first filter 26 for coupling electromagnetic power between the front cavity 36 of the first filter 26 into the output waveguide 24. In the embodiment of FIGS. 1–6, the four slots 60, 62, 64, and 66 are centered on a longitudinal plane of symmetry of the filter system 20, this plane of symmetry being the section employed in FIG. 4 and disclosed by the line 4—4 in FIG. 1. In the alternative embodiment of FIGS. 7 and 8, the two slots 60 and 62 of the input waveguide 22, as well as the two slots 64 and 66 are displaced from each other—by an equal integral number of half guide wavelengths of electromagnetic radiation within the waveguides 22 and 24 to provide more space to facilitate positioning of the filters 26 and 28. The half wavelength relationship in the spacing of the slots along longitudinal axes of the waveguides 22 and 24 preserves the phase quadrature relationship between the signals coupled from the transverse and longitudinal components of the magnetic fields in each of the waveguides 22 and 24.

In the compact physical structure of the embodiment of FIGS. 1–6, the longitudinal slots 62 and 66 are positioned in their respective narrow walls 50 and 48 as close as practicable to the edge of the wall for coupling electromagnetic power to the respective front cavities 36 at locations reasonably close to centers of the front walls 32 of the respective filters 26 and 28. This enhances coupling of electromagnetic power between the narrow walls of the waveguides 22 and 24 and the front cavities 36. In the alternative embodiment of FIGS. 7 and 8, the slot locations are indicated in phantom, and the two waveguides 22 and 24 are displaced in a direction normal to their broad walls to permit alignment of the longitudinal slots 62 and 66 with center lines of the filters 26 and 28 for improved coupling of electromagnetic power via the longitudinal slots 62 and 66 between the waveguides 22, 24, and the front cavities 36.

In operation, the transverse slots 60 and 64 radiate antisymmetrically in their respective waveguides. The longitudinal slots 62 and 66 radiate symmetrically into their respective waveguides. During propagation of electromagnetic power between the input waveguide 22 and the output waveguide 24 by each of the filters 26 and 28, the filters 26 and 28 preserve the quadrature phase relationship of the electromagnetic power coupled from the longitudinal and transverse components of the magnetic field of the TE wave. The quadrature relationship in combination with the summation of symmetric and antisymmetric waves in the output waveguide 24 produces an output wave which exits either from the output port 58 or the output port 56 but not both of these output ports, the specific one of the output ports depending on whether the phase relationship is plus 90 degrees or minus 90 degrees. The phase relationship is reversed by reversal of the point of application of an input signal between the two input ports 52 and 54. Therefore, for application of an input signal to either one of the input ports 52 or 54, there is a specific corresponding one of the output ports 56, 56 from which an output wave will exit. Since the filter system 20 operates as a four-port directional filter, application of an input signal to either one of the input ports 52, 54, results in a reflected signal appearing in the other one of the input ports 54, 52. Therefore, the filter system 20 functions in accordance with the well known scattering matrix for four-port directional filters.

It is also noted that with the offset slot positions disclosed in the alternative embodiment of FIGS. 7–8, that the filter system is operative even if the slots are offset in increments of one quarter of the guide wavelength. In the case of an odd number of quarter wavelengths, signals propagating in the separate paths of the two filters 26 and 28 would be in phase, but the quarter wavelength offset in location of the radiations of the slots 64 and 66 in the output waveguide provide for outputting a signal at only one of the output ports with cancellation at the other output port. The quarter-wavelength offset in position of the radiating slots has the effect of introducing the aforementioned quadrature relationship. The characteristics of the filter system 20 in terms of phase and amplitude to the various spectral components of a signal filtered by the filter system 20 is determined by the filter characteristics of the filters 26 and 28, both of these filters having the same characteristics, as has been noted above. In a preferred embodiment of the invention, the filters 26 and 28 are provided with quasi-elliptic characteristics in a canonical dual linear mode. Such filter characteristic provides for better rejection, delay equalization, and directivity than has been possible heretofore with Chebyshev designed circularly polarized filters which have been used heretofore. Other advantages of the filter system 20 are wider bandwidth and lower loss for the same out of band attenuation.

Figure 6:
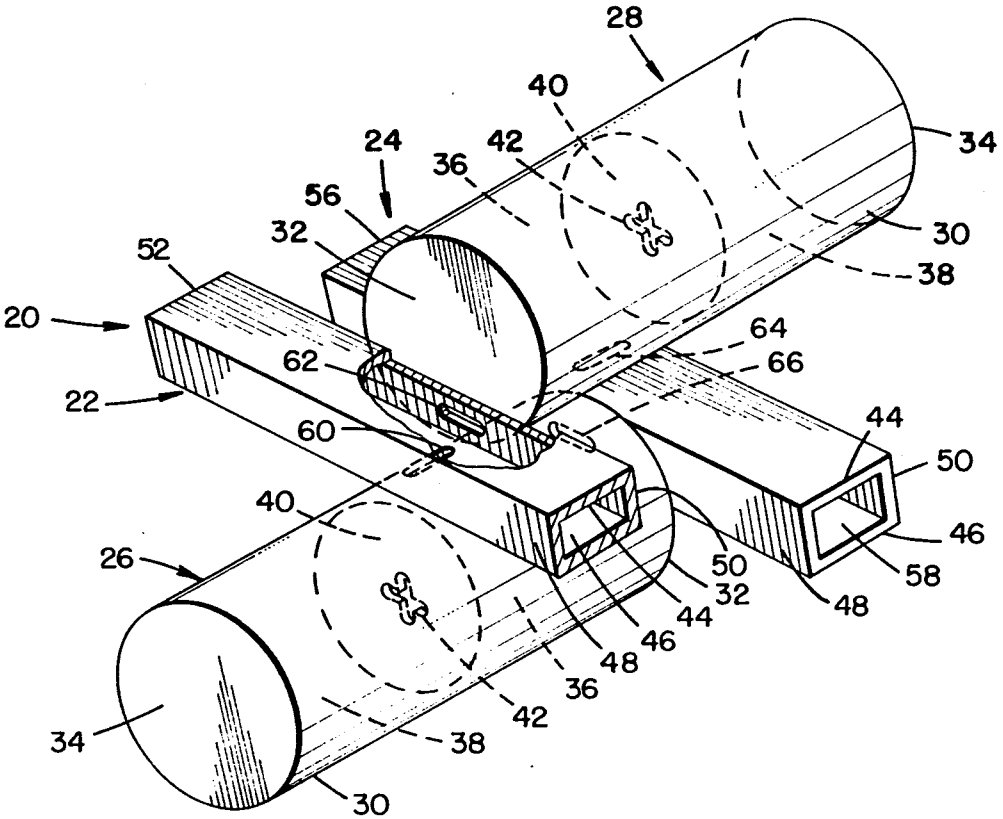
FIG. 6 is a diagrammatic perspective view of the assembly of the filter system of FIG. 1.

By way of example, in the filter configuration disclosed in FIG. 6, wherein each of the filters 26 and 28 has two cavities coupled via the crossed-slot configuration of the iris 42, the filter system 20 operates as a canonical fourth order quasi-elliptic directional filter. Each of the filters 26 and 28 operate as dual mode filters with energy being coupled via field components parallel to both slots of the crossed slot configuration of the iris 42. Such cylindrical cavity filters are well known, and include tuning screws (not shown) which extend radially inward from the sidewall 30 towards a central axis in each of the cavities 36, 38 along radii which are inclined 45 degrees to the slots of the iris 42. As is well known, such screws provide for an interaction between waves coupled by a single slot, such as the transverse slot 60, 64 to provide for the dual modes of operation. The coupling of power into and out of each of the filters 26, 28 is accomplished at the front cavity 36 in which case the back cavity 38 provides for the reflective mode of operation resulting in the fourth order filter characteristic. If desired, a single mode of operation can be employed for each of the filters 26, 28 in which case the crossed slot configuration of the iris 42 would be replaced with a single slot (not shown), this resulting in an in-line version for odd order filters.

By way of further embodiment, it is noted that the coupling devices disclosed for operation with a TE wave are slots. In the event that a transverse magnetic (TM) wave is to be employed, then transverse and longitudinal phase-quadrature components of an electric field are to be coupled from the waveguides into the filters. Instead of the slots, probes (not shown) can be located within the sidewalls of the waveguides for interacting with the transverse and longitudinal components of the electric field for coupling power from these components into the cavities of the filters. The theory of operation of the invention is the same for both TM and TE waves. Also, the theory of the invention applies to the use of filter resonators composed of solid dielectric material (not shown) as well as to the use of resonators constructed as cavities as has been disclosed above.

In view of the foregoing description, the filter system of the invention permits the construction of a four-port directional filter in which the directional properties can be attained independently of the modes of operation of filters of the system and, in particular, in which dual linear modes can be employed in obtaining a quasi-elliptic filter function.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A directional filter system comprising:

a first filter and a second filter, each of said filters having the same filter characteristics;

an input waveguide defining a first input port and a second input port of said system;

an output waveguide defining a first output port and a second output port of said system;

input coupling means for coupling an electromagnetic signal from said input waveguide into each of said filters with introduction of phase quadrature relationship between signals coupled to said first and said second filters; and output coupling means having a first section and a second section for coupling signals outputted by said filters to said output waveguide, said first section connecting with said first filter and radiating symmetrically into said output waveguide, and said second section connecting with said second filter and radiating antisymmetrically to said output waveguide, whereby a signal inputted at one of said input ports is outputted from only one of said output ports.

2. A system according to claim 1 wherein said input coupling means includes a first section connecting with one of said filters and radiating symmetrically into said input waveguide, and a second section connecting with the other of said filters and radiating antisymmetrically into said input waveguide.

3. A system according to claim 2 wherein said input waveguide and said output waveguide are each operative with a transverse-electric (TE) mode of electromagnetic wave having both a transverse and a longitudinal component of magnetic field, and wherein said first section in each of said coupling means is a slot disposed in one of said waveguides parallel to the longitudinal magnetic field component, and wherein said second section in each of said coupling means is a slot in each of said waveguides disposed parallel to the transverse magnetic field component.

4. A system according to claim 3 wherein each of said waveguides has a rectangular cross section and comprises four sidewalls, two of said sidewalls being broad walls and two of said sidewalls being narrow walls, and wherein the slot of said first section of one of said coupling means is located in a narrow wall of the waveguide and the slot of the second section of one of said coupling means is located in a broad wall of the waveguide.

5. A system according to claim 4 wherein said output waveguide is contiguous to each of said filters, one of said filters being electromagnetically coupled to said output waveguide via said slot in said narrow wall and the other of said filters being electromagnetically coupled to said output waveguide via said slot in said broad wall.

6. A system according to claim 5 wherein said input waveguide is contiguous to each of said filters, one of said filters being electromagnetically coupled to said input waveguide via said slot in said narrow wall and the other of said filters being electromagnetically coupled to said input waveguide via said slot in said broad wall.

7. A system according to claim 6 wherein said first filter and said second filter are each configured with a cylindrical sidewall closed off by a front end wall and and a back end wall, the front end wall of said first filter abutting a narrow wall of said output waveguide, the sidewall of said first filter abutting a broad wall of said input waveguide, the back end wall of said second filter abutting a narrow wall of said input waveguide, and the sidewall of said second filter abutting a broad wall of said output waveguide.

8. A system according to claim 7 wherein each of said filters comprises a plurality of cavities separated by a divider wall, there being a coupling aperture in said divider wall for connection between successive ones of said cavities in each of said filters and wherein, in each of said filters, one of said cavities is coupled via a broad-wall slot to one of said waveguides and via a narrow-wall slot to the other of said waveguides.

* * * * *